United States Patent [19]

Damm et al.

[11] 3,933,248

[45] Jan. 20, 1976

[54] BIRD-SWING DETECTOR

[75] Inventors: David A. Damm; John W. Juvinall, both of Toledo; Gerald F. Scherf, Holland, all of Ohio

[73] Assignee: Owens-Illinois, Inc., Toledo, Ohio

[22] Filed: Sept. 30, 1974

[21] Appl. No.: 510,182

[52] U.S. Cl. ..... 209/74 M
[51] Int. Cl.[2] ..... B07C 5/36
[58] Field of Search ..... 209/74 R, 74 M, 111.7; 235/925 H

[56] References Cited

UNITED STATES PATENTS

| | | | |
|---|---|---|---|
| 3,565,249 | 2/1971 | Codding | 209/74 M |
| 3,662,883 | 5/1972 | Sager | 209/111.7 |
| 3,669,263 | 6/1972 | Babb | 209/111.7 X |
| 3,802,559 | 4/1974 | Luchetti | 209/111.7 |
| 3,820,642 | 6/1974 | Levasseur | 194/1 N |

*Primary Examiner*—Robert B. Reeves
*Assistant Examiner*—Joseph J. Rolla
*Attorney, Agent, or Firm*—Steve M. McLary; Edward J. Holler

[57] ABSTRACT

An improved "bird-swing" detector which has a downstream rejection system. An optical type bird-swing detector inspects glass containers as they move therethrough on a conveyor. A container exhibiting a bird-swing defect causes generation of a rejection signal. An oscillator may be set at a frequency in synchronism with the travel of the containers. A wave-shaping circuit forms the output of the oscillator into square waves at the frequency of the oscillator. A flip-flop has one input connected to the rejection signal and another input terminal connected to the wave-shaping circuit. The flip-flop output is connected to a multi-stage shift register. The signal from the wave-shaping circuit clocks the shift register. The switching of the flip-flop is delayed to allow entry of any information therefrom into the shift register before the flip-flop is reset. A reject or defective container signal is clocked through the shift register in synchronism with the travel of a defective container on the conveyor. In a rejection zone, downstream of the detector, a rejection mechanism is activated by a one-shot to reject the container. The final stage output of the shift register is gated with the signal from the wave-shaping circuit to turn on the one-shot at the proper time for rejection of a defective container.

1 Claim, 1 Drawing Figure

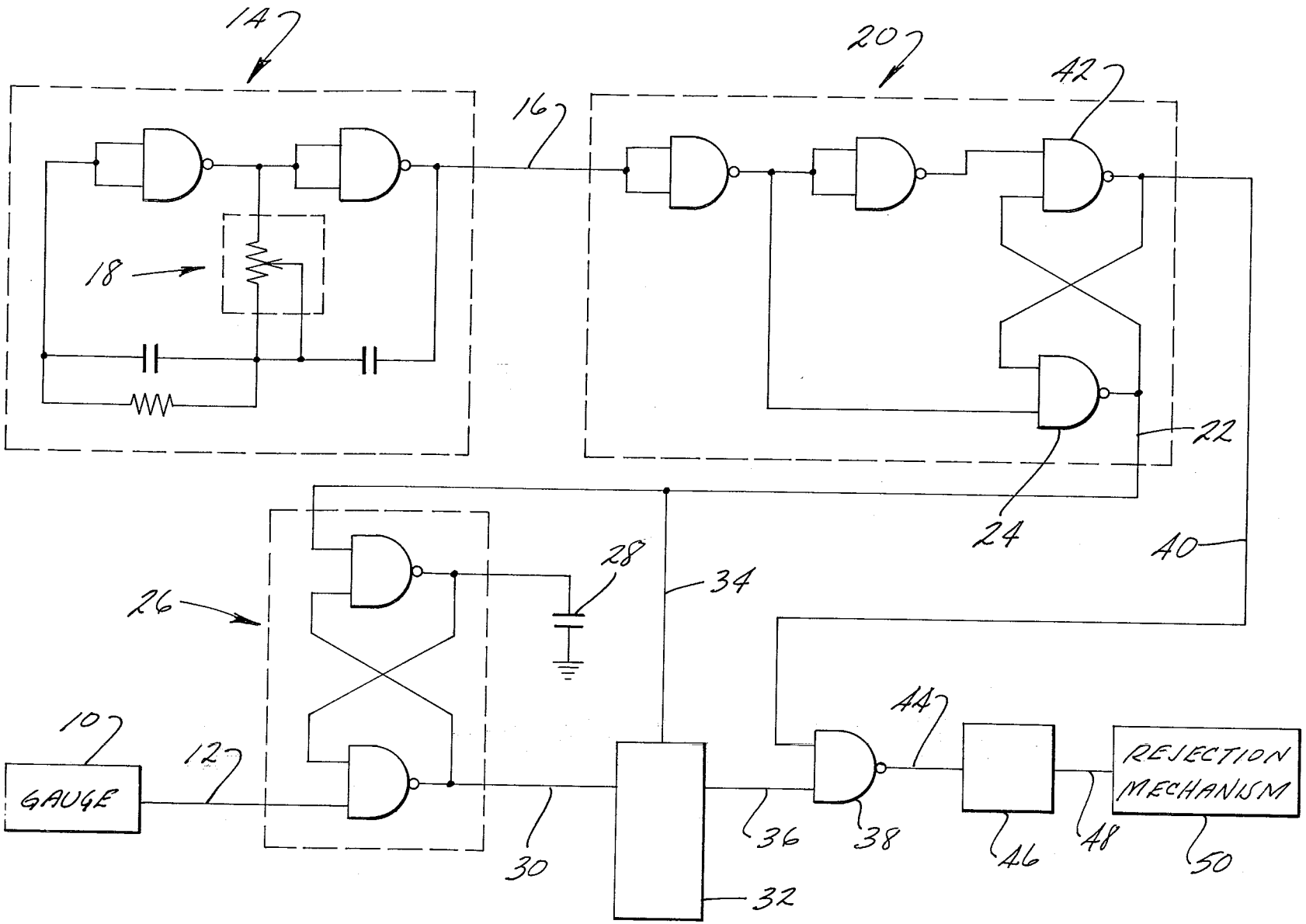
REJECTION MECHANISM
GAUGE
10
12
14
16
18
20
22
24
26
28
30
32
34
36
38
40
42
44
46
48
50

BIRD-SWING DETECTOR

BACKGROUND OF THE INVENTION

This invention generally relates to the inspection of glass containers. More particularly, the invention relates to an apparatus for inspecting glass containers for a defect known as a bird-swing. Specifically, this invention relates to an improvement in such inspection devices which allows rejection of a defective container at a remote location downstream of the inspection device.

A bird-swing detector for glass containers may be seen in U.S. Pat. No. 3,662,883. The device has proven effective in detecting bird-swing defects. However, an operational problem with this gauge has arisen as the number of containers to be inspected per unit time has increased. At higher container throughput rates, defective containers could not be reliably rejected at the gauge output end. The cited patent shows rejecting a defective container as soon as it leaves the gauge. At the higher speeds, a defective container occasionally may not be cleared before the following container struck it, or, in some cases, the rejection mechanism could not react fast enough and the defective container could be passed while the next, good container would be rejected. To avoid this congestion at the gauge exit, we have designed a memory system which will clock a signal representing a defective container at a rate equal to the rate of travel of the container and then reject the container at a remote location downstream of the gauge exit. Examples of the prior art in this respect may be seen in U.S. Pat. Nos. 3,471,012; 3,565,249 and 3,757,940.

SUMMARY OF THE INVENTION

Our invention is an improvement in an apparatus for the inspection of containers for the presence of a defect known as a bird-swing. In this apparatus, containers are transported in single file on a conveyor to and through the apparatus. The containers are inspected by a light beam while moving through the apparatus and a rejection signal is generated if a bird-swing defect is detected. The improvement is a downstream rejection system. The rejection system includes an oscillator for producing a continuous series of electrical pulses. Connected to the oscillator is a means for varying the frequency of the oscillator to allow synchronism of the oscillator frequency with the rate of travel of the containers on the conveyor. A wave-shaping circuit is connected to the oscillator to shape the pulses from the oscillator into a substantially square wave pattern at the same frequency as the oscillator frequency. A flip-flop has one input terminal connected to the wave-shaping circuit and a second input terminal connected to the inspection apparatus to receive any rejection signal generated. Connected to the flip-flop is a means for delaying actuation of the flip-flop a pre-determined length of time after the receipt of a signal from the wave-shaping circuit. A multi-stage shift register has a clocking input terminal connected to the wave-shaping circuit and a signal input terminal connected to an output terminal of the flip-flop. An output electronic gate has one input terminal connected to the wave-shaping circuit and a second input terminal connected to an output terminal of the shift register. The output electronic gate will generate an output signal at its output terminal only when both the shift register and the wave-shaping circuit are furnishing a signal. A one-shot unit connected to the output terminal of the output electronic gate will generate a signal in response to a signal from the output electronic gate. The one-shot controls operation of a rejection means which will remove containers from the conveyor in response to a signal from the one-shot unit. The rejection means is positioned at a location adjacent to the conveyor and downstream from the inspection apparatus.

BRIEF DESCRIPTION OF THE DRAWINGS

The single drawing FIGURE is a schematic circuit diagram of the downstream rejection system of the present invention.

DETAILED DESCRIPTION OF THE DRAWINGS

This invention is an improved rejection system for a device to detect the defect known as bird-swings in glass containers. U.S. Pat. No. 3,662,883 shows a bird-swing detector of the type which may be utilized with the present invention. The teachings of this patent are hereby incorporated by reference.

The drawing FIGURE illustrates the electronic circuit of the present invention. In this circuit it should be realized that some resistors and capacitors which are used for noise suppression or signal smoothing have been omitted in the interests of clarity. The use of such devices would, of course, be obvious to those skilled in the art. In addition, the connection of active elements of the circuit to the circuit power supply has also been omitted. Again, these connections to the powder supply should be obvious to those skilled in the art. As a final note, this circuit is designed to run on a negative logic, that is, the absence of a signal indicating an informational bit. It would be possible to operate such a system in a reverse manner or on a positive logic system, but commercially available components are such that the use of the negative logic system is more convenient.

In the drawing FIGURE, the bird-swing detector or gauge 10 of U.S. Pat. No. 3,662,883 furnishes a signal along a conductor 12 when a defective container has been detected. The purpose of the present invention is to allow rejection of such a container at a position considerably downstream from the actual location of the gauge 10. As seen in the referenced-patent, the glass containers which are gauged are moving along on an endless conveyor belt. In the prior art, a bottle which contained a bird-swing defect would cause generation of a rejection signal, and the glass container would be rejected immediately after it exited from the gauge 10. This was undesirable since in many cases the rate of inspection was relatively high and it became difficult to remove defective containers immediately upon their exit from the gauge 10. Jams often occurred at this point of defective containers might not be rejected properly. Thus, the present invention will allow rejection of a defective container from the conveyor on which the glass containers are travelling at a remote position downstream. An oscillator 14 of conventional design furnishes an oscillating electrical signal through a conductor 16. The oscillator 14 contains within it a variable resistor 18, whose purpose will be explained later. The signal from the oscillator 14 is furnished to a wave-shaping device 20 which changes the somewhat rounded contours of the oscillating signal from the oscillator 14 to a series of relatively sharp square waves for utilization in the remainder of the circuit. One output from the wave-shaping circuit 20 is along a conductor 22 from a NAND gate 24 which is a part of the wave-shaping circuit 20. The conductor 22 is connected to one input of a conventional flip-flop 26. The conductor 12 carrying information from the gauge 10 is connected to a second input of the flip-flop 26. A grounded capacitor 28 is also connected to one output of the flip-flop 26 to serve a purpose which will be described later. The output of the flip-flop 26 is through a conductor 30 to the input of a multiple stage shift register 32. The shift register 32 may have any desired number of stages which are required to allow rejection of a defective glass container at a particular location down-stream. However, one example of the shift register 32 may be two 18-stage shift registers which are connected in a series cascaded arrangement. A branch conductor 34 is connected to the conductor 22 and to a clocking input of the shift register 32. A conductor 36 connects the output of the shift register 32 to one input of an output NAND gate 38. A second input to the output NAND gate 38 is from a conductor 40 which is connected to the wave-shaping circuit 20. It is important to realize that the signal which is carried by the two conductors 22 and 40 from the wave-shaping circuit 20 carry the same information except that the information is inverted in sign. Thus, the output line 40 is necessary to furnish the signal of the proper sign to the output NAND gate 38. The conductor 22 could just as well furnish the same signal to the output NAND gate 38 but an additional signal inverter would have to be incorporated before this connection could be made. By connecting the conductor 40 as shown to a second NAND gate 42 which is a part of the wave-shaping circuit 20, this additional circuit element may be dispensed with. The output of the NAND gate 38 is connected through a conductor 44 to a monostable multivibrator or one-shot unit 46. The one-shot 46 conducts its signal through a conductor 48 to a rejection mechanism 50 which may be any type of desired rejection mechanism that will sweep a defective glass container from the conveyor on which it is travelling. Such rejection mechanisms may take the form of a solenoid operated valve which will allow an air blast to move the container, a solenoid which will mechanically operate an arm to sweep the container from the conveyor, or a solenoid valve which will admit air to an air cylinder that will extend to remove the defective container from the conveyor. In the most general sense, any form of mechanism which can be actuated in response to an electrical signal as furnished along the conductor 48 may be used as a rejection mechanism 50.

The operation of this apparatus may be briefly described as follows: the oscillator 14 has a natural frequency at which it will generate pulses that will travel along the conductor 16. However, this pulse frequency will not necessarily correlate or be synchronized with the speed at which the glass containers will be travelling along the conveyor for inspection by the gauge 10. Thus, it is necessary to set the speed of oscillation or frequency of oscillation by use of the variable resistor 18. The variable resistor 18 provides a means for varying the frequency of the oscillator 14 to allow synchronism of the frequency with the rate of travel of containers on the conveyor. It may be realized that the position of the variable resistor 18 within the circuit of the oscillator 14 will allow adjustment of the frequency of oscillation as a function of the setting of the variable resistor 18. In the setup of this apparatus, it is therefore necessary to allow some glass containers to travel along the conveyor and to adjust the variable resistor 18 until the pulse frequency is such that a pulse will arrive at the final stage of the shift register 32 just as the container itself arrives in the area which is controlled by the rejection mechanism 50. This particular form of control of the frequency well-defined of oscillation allows simplification of the entire system since a complex shaft encoder or tachometer system which continually reads the conveyor speed is not required. The wave-shaping circuit 20 is used to provide sharp well defined square pulses which will operate the flip-flop 26 and the shift register 32 in a precise and definite pattern. The slightly rounded pulses which are actually produced by the oscillator 14 could lead to inaccuracies in shifting information or switching from one state to another. Each time the sharp edge of a pulse occurs, this transmitted through the conductor 34 to the shift register 32 which clocks the shift register 32 or moves all information in the various stages of the register one position further. This is a conventional and well known method of operation of a shift register. In addition, the same pulse enters the flip-flop 26 to reset the flip-flop 26. However, note the grounded capacitor 28 connected to the flip-flop 26. Since the same pulse both clocks the shift register 32 and resets the flip-flop 26, it is desirable that any information in the shift register be shifted or moved before a signal on the conductor 30 from the flip-flop be removed by resetting of the flip-flop 26. The grounded capacitor 28 provides this particular capability. The grounded capacitor 28 serves as a means for delaying resetting of the flip-flop 26 a pre-determined length of time after receipt of a signal from the wave-shaping circuit 20. The value of the capacitor 28 determines the length of delay. Before the flip-flop 26 can be reset by the square wave signal, the capacitor 28 must be charged up, thus allowing a slight delay before the flip-flop 26 will be reset. During this delay time, the shift register 32 has moved all of the information contained therein one place as a result of the signal provided on the conductor 34. Then, the flip-flop 26 will change state and a signal, if there was one present on the conductor 30, will cease. In this respect, whenever a signal is presented by the conductor 12 from the gauge 10, a defective glass container has been found. This signal on the conductor 12 sets the flip-flop 26 such that a signal will be presented on the conductor 30. Then, the next incoming square wave will enter this information into the shift register 32 will reset the flip-flop 26 to accept a new signal on the conductor 12 if one should be immediately following. Under normal conditions, where there are no defective containers being produced, the flip-flop 26 remains in a single state, since the input of the square waves has no need to reset the flip-flop 26 because it has not been set by a signal along the conductor 12. Any defective container signal entered into the shift register 32 is moved through the shift register 32 in synchronism with the pulses that are furnished along the conductor 34 into the shift register 32. Keep in mind that this rate of progression or frequency of the oscillator 14 has previously been set so that the defective container will arrive at the area controlled by the rejection mechanism 50 just as this information exits from the shift register 32 along the conductor 36. Thus assuming that a signal has been entered in the shift register 32 indicating a defective container, this information will be finally furnished as an output along the conductor 36 to the output NAND gate 38. However, the output NAND gate 38 will not produce a signal until after it has received a signal along the conductor 40 which is a signal indicating the beginning of the next wave or cycle from the oscillator 14. At this point, with both signals present, an output will be generated along the conductor 44 which will activate the one-shot 46 in turn generating the signal along the conductor 48 to the rejection mechanism 50 which will then be actuated to remove a defective container from the conveyor.

We claim:

1. In an apparatus for the inspection of containers for bird-swing defects of the type wherein said containers are transported in single file by an endless moving conveyor to and through said apparatus, wherein said containers are inspected by a light beam while moving through said apparatus, and wherein deflection of said light beam by a bird-swing defect will cause generation of a rejection signal, the improvement in said apparatus of a downstream rejection system for said apparatus which comprises, in combination:

an oscillator for producing a continuous series of electrical pulses;

means, connected to said oscillator, for varying the frequency of said oscillator to allow synchronism of said frequency with the rate of travel of said containers on said conveyor;

a wave-shaping circuit, connected to said oscillator, for shaping the pulses from said oscillator into a substantially square wave pattern at the same frequency as said oscillator frequency;

a flip-flop having one input terminal connected to said wave-shaping circuit and a second input terminal connected to said inspection apparatus to receive said rejection signal;

a capacitor, having one side connected to ground and the other side thereof connected to said flip-flop, for delaying the resetting of said flip-flop a predetermined length of time after receipt of a signal from said wave-shaping circuit, the value of said capacitor fixing said pre-determined length of time of said delay;

a multi-stage shift register having a clocking input terminal connected to said wave-shaping circuit and a signal input terminal connected to an output terminal of said flip-flop;

an output electronic gate having one input terminal connected to said wave-shaping circuit and a second input terminal connected to an output terminal of said multi-stage shift register, said output electronic gate generating an output signal at an output terminal thereof only when both said multi-stage shift register and said wave-shaping circuit furnish a signal thereto;

a one-shot unit, connected to said output terminal of said output electronic gate, for generating a signal in response to a signal from said output electronic gate; and rejection means, responsive to a signal from said one-shot unit, for removing containers from said conveyor, said rejection means being positioned at a location adjacent said conveyor and downstream from said inspection apparatus.

* * * * *